US007489184B2

(12) United States Patent
Pan et al.

(10) Patent No.: US 7,489,184 B2
(45) **Date of Patent: *Feb. 10, 2009**

(54) DEVICE AND METHOD FOR GENERATING A LOW-VOLTAGE REFERENCE

(75) Inventors: Dong Pan, Boise, ID (US); Greg A. Blodgett, Nampa, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/711,563

(22) Filed: Feb. 27, 2007

(65) Prior Publication Data

US 2007/0159238 A1 Jul. 12, 2007

Related U.S. Application Data

(63) Continuation of application No. 11/196,978, filed on Aug. 4, 2005, now Pat. No. 7,256,643.

(51) Int. Cl.
*G05F 1/10* (2006.01)

(52) U.S. Cl. ..... 327/539; 327/512; 327/513; 327/538

(58) Field of Classification Search ..... None
See application file for complete search history.

(56) References Cited

U.S. PATENT DOCUMENTS 5,352,973 A 10/1994 Audy
5,359,552 A * 10/1994 Dhong et al. ..... 365/189.9
5,835,420 A 11/1998 Lee et al.
5,933,045 A 8/1999 Audy et al.
6,009,022 A 12/1999 Lee et al.
6,489,831 B1 12/2002 Matranga et al.
6,545,923 B2 4/2003 Sim et al.
6,563,371 B2 * 5/2003 Buckley et al. ..... 327/539
6,714,462 B2 3/2004 Pan
6,765,431 B1 7/2004 Coady
6,809,986 B2 10/2004 Kim et al.
6,838,864 B2 1/2005 Di Iorio
6,847,560 B2 1/2005 Pan
6,933,769 B2 8/2005 Koelling
7,112,948 B2 * 9/2006 Daly et al. ..... 323/316
7,113,025 B2 9/2006 Washburn
7,166,994 B2 * 1/2007 Lee et al. ..... 323/313
7,170,274 B2 1/2007 Mukherjee et al.
7,170,336 B2 * 1/2007 Hsu ..... 327/539
7,193,454 B1 * 3/2007 Marinca ..... 327/539
2006/0001413 A1 1/2006 Marinca

OTHER PUBLICATIONS

Phang et al., "Low Voltage, Low Power CMOS Bandgap References," University of Toronto (date unknown) pp. 1-17.
Waltari et al., "Reference Voltage Driver for Low-Voltage CMOS A/D Converters," IEEE (2000) pp. 28-31.

* cited by examiner

*Primary Examiner*—N. Drew Richards
*Assistant Examiner*—An T. Luu
(74) *Attorney, Agent, or Firm*—TraskBritt

(57) ABSTRACT

A voltage reference generating method, source, memory device and substrate containing the same include a voltage reference generator comprised of a bandgap voltage reference circuit including a first complementary-to-absolute-temperature (CTAT) signal and a second complementary-to-absolute-temperature (CTAT) signal. The voltage reference generator further includes a differential sensing device for generating a reference signal substantially insensitive to temperature variations over an operating temperature range by differentially sensing the first and second CTAT signals. The method includes generating first and second complementary-to-absolute-temperature (CTAT) signals and generating a reference signal that is substantially insensitive to temperature variations over an operating temperature range.

15 Claims, 6 Drawing Sheets

DEVICE AND METHOD FOR GENERATING A LOW-VOLTAGE REFERENCE

CROSS-REFERENCE TO RELATED APPLICATION

This application is a continuation of application Ser. No. 11/196,978, filed Aug. 4, 2005, now U.S. Pat. No. 7,256,643, issued Aug. 14, 2007. The disclosure of the previously referenced U.S. patent application is hereby incorporated by reference in its entirety.

BACKGROUND OF THE INVENTION

1. Field of the Invention

The present invention relates to a method and apparatus for generating a reference signal and, more particularly, to generating a low-voltage reference signal for integrated circuits such as memory devices.

2. State of the Art

Dynamic random access memory (DRAM) devices provide a relatively inexpensive way to provide a large system memory. DRAM devices are relatively inexpensive because, in part, as compared to other memory technologies, a typical single DRAM cell consists only of two components: an access transistor and a capacitor. The access transistor is typically a metal oxide (MOS) transistor having a gate, a drain, and a source, as will be understood by those skilled in the art. The capacitor, which stores a high or low voltage representing high and low data bits, respectively, is coupled between the drain of the access transistor and a cell plate charged to Vcc/2. The gate of the access transistor is coupled to a word line and the source is coupled to a digit line. Thus, activating the word line turns on the transistor, coupling the capacitor to the digit line and thereby enabling data to be read from the DRAM cell by sensing the voltage at the digit line. Data is written to the DRAM cell by applying a desired voltage to the digit line.

DRAM technology is an inherently transitory nature storage technology. As is well known in the art, the storage capability of the DRAM cell is transitory in nature because the charge stored on the capacitor leaks. The charge can leak, for example, across the plates of the capacitor or out of the capacitor through the access transistor. The leakage current through a MOS transistor is an unwanted current flowing from drain to source even when the gate-to-source voltage of the transistor is less than the threshold voltage, as will be understood by those skilled in the art. As a result, DRAM cells must be refreshed many times per second to preserve the stored data. With the refresh process being repeated many times per second, an appreciable quantity of power is consumed. In portable systems, obtaining the longest life out of the smallest possible battery is a crucial concern, and, therefore, reducing the need to refresh memory cells and, hence, reducing power consumption is highly desirable.

The refresh time of a memory cell is degraded by two major types of leakage; current junction leakage current caused by defects at the junction boundary of the transistor and channel leakage current caused by sub-threshold current flowing through the transistor. The junction leakage current may be reduced by decreasing the channel implantation dose which may undesirably cause an increase in the channel leakage. Similarly, the sub-threshold current may be reduced by increasing the threshold voltage of the transistor which may cause an increase in the junction leakage current.

A negatively biased word line scheme has been devised to reduce both the junction leakage current and the channel leakage current at the same time. In such an approach, the memory device employing a negative word line scheme applies a negative voltage of typically −0.5 to −0.2 volts to the word lines of the non-selected memory cells.

As stated, the need to refresh memory cells can be reduced by reducing current leakage through the access transistor by increasing the threshold voltage of the access transistor. The semiconducting materials comprising the DRAM cells can be doped to increase the threshold voltage to activate the transistor from a typical level of 0.6 volts to 1.0 or more volts. Increasing the threshold voltage, because of the field effects in the MOS transistors used in typical DRAM cells, reduces the magnitude of current leakage through the access transistor. This is true because, as will be understood by those skilled in the art, when the polarity of the applied gate-to-source voltage causes the transistor to turn OFF, current decreases as the difference between the applied gate-to-source-voltage and threshold voltage increase. Thus, for a given voltage applied on a word line to turn OFF the corresponding access transistors, an increase in the threshold voltage will decrease the leakage current of the transistor for that word line voltage.

Increasing threshold voltage to suppress current leakage, however, becomes a less optimal solution as memory cells are reduced to fit more and more memory cells on a single die. This is because, for example, miniaturization of memory cells results in cell geometries that render the cells vulnerable to damage as higher voltages are applied.

Instead of increasing the threshold voltage of the access transistor and leaving the applied word line voltage the same, leakage current can be reduced by increasing the magnitude of the gate-to-source voltage that is applied to turn OFF the access transistor and leaving the threshold voltage of the transistor the same. Thus, instead of applying zero volts on the word line to turn OFF an NMOS access transistor, a negative voltage of −0.3 volts may be applied to the word line, decreasing the transistor's current leakage for a given threshold voltage.

The application of a negative voltage to the word line must be precisely controlled or the channel of the pass gate which isolates the storage capacitor may be significantly stressed or completely damaged. Therefore, a stable and accurate voltage reference has been conventionally employed for generating a negative voltage word line ($V_{NWL}$) signal. Desirably, precision voltage references should be insensitive to variations in process (P), temperature (T) and supply voltage (V).

One of the more popular voltage reference generators for generating a negative voltage reference signal for coupling to the inactive word lines includes a bandgap voltage reference. Typically, a bandgap voltage reference circuit uses the negative temperature coefficient of emitter-base voltage differential of two transistors operating at different current densities to make a zero temperature coefficient reference. Such an approach proved adequate until advances in sub-micron CMOS processes resulted in supply voltages being scaled-down with the present processes operating at sub 1 volt supply voltages. This trend presents a greater challenge in designing bandgap reference circuits which can operate at very low voltages. Even though conventional low-voltage bandgap circuits can generate a low voltage PVT insensitive voltage reference generator (e.g., approximately 0.6 V), the minimum Vcc required for proper operation at cold temperatures is approximately 1.05 V. Such a high minimum Vcc results from a high forward bias voltage of the PN diode junction.

FIG. 1 illustrates a conventional circuit diagram of a voltage reference generator 10 including a bandgap voltage reference 12 configured to generate a signal $V_{bandgap}$ 14. The bandgap voltage reference 12 includes a differential amplifier 18 coupled on a first input to a divider network including a resistive (L*R) element 20 and a diode (1×) element 22. A second input of the differential amplifier 18 is coupled to a divider network including a resistive (L*R) element 24, resistive (R) element 26 and a diode array (8×) element 28. The signal $V_{bandgap}$ 14 couples to a differential amplifier 30 and generates a reference signal 32. In the conventional voltage reference generator 10, the bandgap voltage reference 12 outputs the signal $V_{bandgap}$ 14 with a potential of approximately 1.2 volts to 1.3 volts. The signal $V_{bandgap}$ 14 goes through the differential amplifier 30 to generate the reference signal 32 having a potential of approximately −0.3 volts. The signal $V_{bandgap}$ 14 must be set about 1.3 volts to get the zero temperature coefficient as shown by:

$$(V_{bandgap})=L*n*\ln K*V_t+V_{d1}$$

where, L is the resistor ratio, n is the process constant (approx.=1), K is the BJT ratio, $V_t$ is the thermal voltage (about 25.6 mV at room temp, has temp. coefficient of about 0.085 mV/C), and $V_{d1}$ is the voltage at the 1× diode (about 0.65 volts at 27° C., has temp. coefficient of about −2.2 mV/C).

In order to have a zero temperature coefficient, L*n*ln K*0.085 mV=2.2 mV, so the L*n*ln K must be about 2.2 mV/0.085 mV=25.8.

Thus, $V_{bandgap}$=25.8*25.6 mV+0.65=1.31 volts.

Since the $V_{bandgap}$ is about 1.3 volts, the minimum power supply voltage for the bandgap shown in FIG. 1 must be higher than 1.3 volts, which is unacceptable for circuits that operate on a Vcc of less than 1.2 volts.

FIG. 2 illustrates another conventional circuit diagram of a voltage reference generator 50 which includes a bandgap voltage reference 52 which is configured to generate a signal $V_{bandgap}$ 54. The bandgap voltage reference 52 includes a differential amplifier 58 coupled on a first input to a network including a resistive element 60 and a diode (1X) element 62. A second input of the differential amplifier 58 is coupled to a network including a resistive element 64 and a diode array (8X) element 66. The signal $V_{bandgap}$ 54 couples to a unity buffer 68 and a differential amplifier 70 and generates a reference signal 72. In the conventional voltage reference generator 50, the CTAT current flows through a PTAT resistor 74 to generate a zero temperature coefficient signal $V_{bandgap}$ 54 of about 0.6 volts. The voltage reference generator is then buffered and connected to the differential amplifier 70 to generate a −0.3 volt reference voltage. One disadvantage of this approach occurs during cold temperature operation when the voltage on the diode element 62 at the cold temperature becomes higher (e.g., about 0.82 volts at −40° C.). Accordingly, additional voltage (e.g., 0.2 volts to 0.3 volts) is needed for the PMOS devices in the amplifiers to remain in the saturation region. Thus, the minimum power supply voltage for the bandgap voltage reference 52 shown in FIG. 2 must be higher than 0.82 volts+0.23 volts=1.05 volts. Although the bandgap voltage reference 52 may output a lower potential for signal $V_{bandgap}$ 54 than the conventional bandgap voltage reference 12 of FIG. 1, the minimum acceptable Vcc of the voltage reference generator 50 of FIG. 2 remains above 1.0 volts (e.g., 1.05 volts) which is unacceptable for circuits that desire to operate on a Vcc operating supply of less than 1.0 volt.

Therefore, what is needed is a method and apparatus for generating a reference signal that remains relatively stable for a broader range of operating voltages including lower operating potentials that would otherwise result in device operation outside of the saturation region of circuit devices.

BRIEF SUMMARY OF THE INVENTION

The various embodiments of the present invention provide techniques for generating a reference signal for a reduced operating voltage. The resulting reference signal is generally and substantially independent of processing (P), operating voltage (V) and temperature (T) variations.

In one embodiment of the present invention, a voltage reference generator is provided. The voltage reference generator includes a bandgap voltage reference configured to generate a first complementary-to-absolute-temperature (CTAT) signal and a second complementary-to-absolute-temperature (CTAT) signal. The voltage reference generator further includes a differential sensing device for generating a reference signal substantially insensitive to temperature variations over an operating temperature range by differentially sensing the first and second CTAT signals.

In another embodiment of the present invention, a memory device is provided. The memory device includes a memory array and a voltage reference generator configured to facilitate data exchange with the memory array. The voltage reference generator includes a bandgap voltage reference configured to generate a first complementary-to-absolute-temperature (CTAT) signal and a second complementary-to-absolute-temperature (CTAT) signal. The voltage reference generator further includes a differential sensing device for generating a reference signal substantially insensitive to temperature variations over an operating temperature range by differentially sensing the first and second CTAT signals.

In a further embodiment of the present invention, an electronic system is provided. The electronic system includes an input device, an output device, a memory device, and a processor device coupled to the input, output, and memory devices with at least one of the input, output, memory, and processor devices including a memory cell including at least one word line coupled to a reference signal of a voltage reference generator. The voltage reference generator includes a bandgap voltage reference configured to generate a first complementary-to-absolute-temperature (CTAT) signal and a second complementary-to-absolute-temperature (CTAT) signal. The voltage reference generator further includes a differential sensing device for generating a reference signal substantially insensitive to temperature variations over an operating temperature range by differentially sensing the first and second CTAT signals.

In yet another embodiment of the present invention, a semiconductor substrate on which is fabricated a memory device is provided. The memory device includes a memory array of memory cells and a voltage reference generator configured to facilitate data within the retention memory array. The voltage reference generator includes a bandgap voltage reference including a first complementary-to-absolute-temperature (CTAT) signal and a second complementary-to-absolute-temperature (CTAT) signal. The voltage reference generator further includes a differential sensing device for generating a reference signal substantially insensitive to temperature variations over an operating temperature range by differentially sensing the first and second CTAT signals.

In yet a further embodiment of the present invention, a method for generating a reference signal is provided. The method includes generating a first complementary-to-absolute-temperature (CTAT) signal and generating a second complementary-to-absolute-temperature (CTAT) signal. Additionally, a reference signal is generated that is substantially insensitive to temperature variations over an operating temperature range by differentially sensing the first and second CTAT signals.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

A voltage reference generator provides a stable reference signal to one or more electrical circuits in an electronic device. In one example of an electronic device, a memory device including a plurality of memory storage cells requires stable reference signals to minimize data corruption or "upset" due to leakage current. Similarly, voltage levels of the reference signals may be adjusted to provide improved performance in circuits subjected to reduced dynamic range of operational voltage levels. Also, the improved voltage reference generator provides expanded tolerance for operational voltage variations due to variations in operational voltage sources and operational and implementation extremes resulting from device processing (P) variations, operational voltage (V) source variations, and operational temperature (T) variations, generally known as PVT corners, when graphically plotted.

Figure 3:
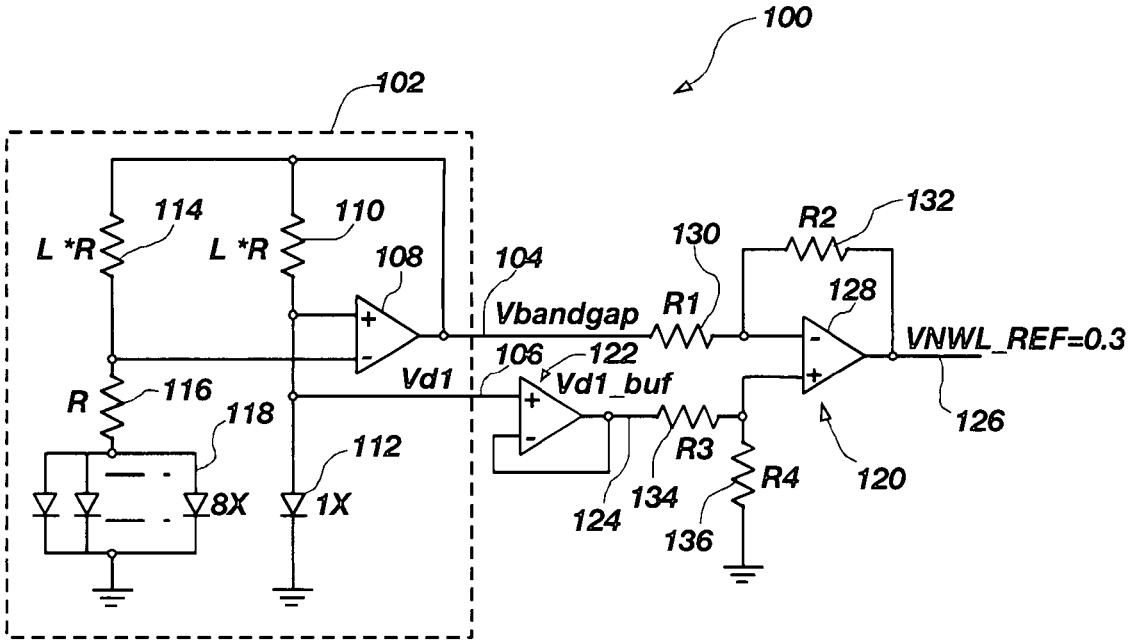
FIG. 3 is a circuit diagram of a voltage reference generator, in accordance with an embodiment of the present invention.

FIG. 3 is a circuit diagram of a voltage reference generator, in accordance with an embodiment of the present invention. The voltage reference generator embodiments of the present invention find application to memory devices and, in particular, to low-voltage DRAM devices. The voltage reference generator provides low-voltage operation over a lesser operating voltage than conventional bandgap reference generators.

Referring to FIG. 3, a voltage reference generator 100 includes a low-voltage bandgap voltage reference circuit 102 which is configured to generate a first complementary-to-absolute-temperature (CTAT) signal $V_{bandgap}$ 104 and a second complementary-to-absolute-temperature (CTAT) signal $V_{d1}$ 106. The bandgap voltage reference circuit 102 includes a differential amplifier 108 coupled at a first input to a divider network including a resistive (L*R) element 110 and a diode (1×) element 112. A second input of the differential amplifier 108 is coupled to a divider network including a resistive (L*R) element 114, resistive (R) element 116 and a diode array (8×) element 118.

For calculation of the element values for the bandgap voltage reference circuit 102, $$V_{bandgap}=L*n*\ln K*V_t+V_{d1}$$

where, L is the resistor ratio, n is the process constant (approx.=1), K is the BJT ratio, $V_t$ is the thermal voltage (about 25.6 mV at room temperature, has temperature coefficient (TC) of about 0.085 mV/C), and $V_{d1}$ is the voltage at the 1× diode (about 0.65 volts at 27° C., has temperature coefficient of about −2.2 mV/C).

Figure 1:
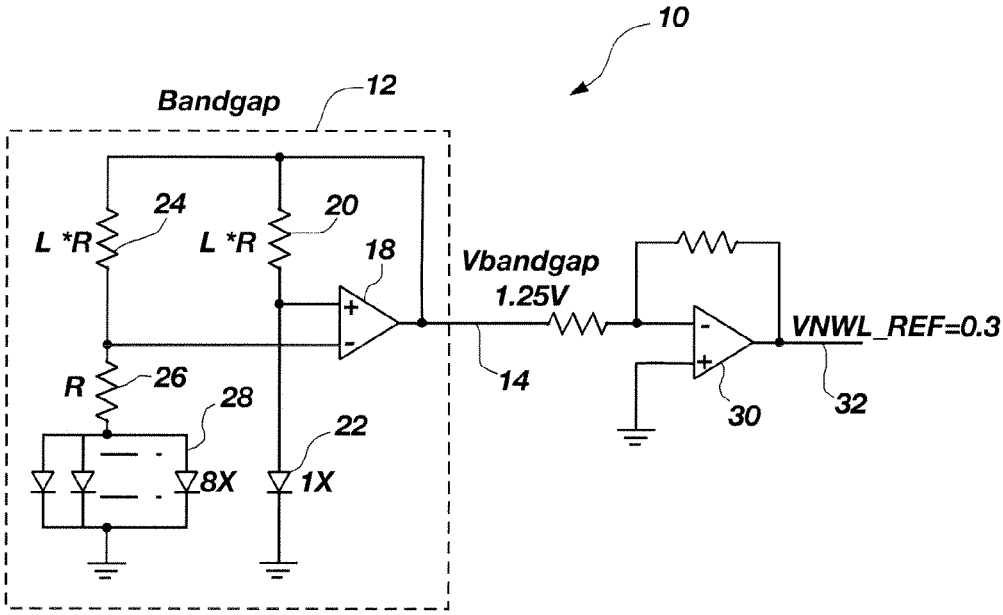
FIG. 1 (PRIOR ART)
FIG. 1 is a circuit diagram of a conventional negative voltage reference generator, in accordance with the prior art.

In the bandgap voltage reference 102 of FIG. 3, instead of setting, for example, L*n*ln K=25.8 to get the zero temperature coefficient (TC) for the bandgap reference of FIG. 1, the equation is set such that L*n*ln K=8. Therefore, $$V_{bandgap}=8*25.6\text{ mV}+0.65=0.85\text{ volts at }27^\circ\text{ C.}$$

$$V_{bandgap}=0.085\text{ mV}*(-40-27)*8-2.2\text{ mV}*(-40-27)+0.85=0.95\text{ V at }-40^\circ\text{ C.}$$

While the temperature coefficient (TC) is not zero, the minimum power supply voltage may be slightly higher than 0.95 volts at cold temperature.

The voltage reference generator 100 further includes a differential sensing device 120 configured as an inverting amplifier. As shown in FIG. 3, the first CTAT signal 104 is connected to the differential sensing device 120 and the second CTAT signal 106 is connected to a unity gain buffer 122 with the resultant signal, a buffered second CTAT signal 124 connecting to the differential sensing device 120 to provide an acceptable input impedance to the differential sensing device 120. A reference signal 126 from a differential amplifier 128 is calculated as:

$$V_{nwl_ref}=V_{d1}*(R1+R2)*R4/((R3+R4)*R1)-V_{bandgap}*R2/R1$$

Values for resistors 130-136 may be selected by setting (R1+R2)*R4/((R3+R4)*R1) =0.5 and R2/R1=0.735.

Thus, $V_{nwl_ref}=0.5*V_{d1}-0.735*V_{bandgap}$.

$V_{nwl_ref}=0.5*0.65-0.73*0.85=-0.3$ V at 27° C.

$$\begin{aligned}\text{Similarly, } V_{nwl_ref} &= 0.5*V_{d1}-0.735*V_{bandgap}.\\ &= 0.5*V_{d1}-0.73*(L*n*\ln K*V_t+V_{d1})\\ &= -0.23*V_{d1}\cdot 0.73*8*V_t\\ &= -0.23*V_{d1}\cdot 5.84*V_t\end{aligned}$$

Since the $V_{d1}$ has −2.2 mV/C temperature coefficient (TC) and Vt has 0.085 mV/C temperature coefficient (TC), the $V_{nwl_ref}$ will have −0.23*(−2.2 m)−5.85*0.085 m=0 temperature coefficient (TC).

Accordingly, the voltage reference generator 100 generates a reference signal 126 based upon two separate complementary-to-absolute-temperature (CTAT) signals, namely the first CTAT signal 104 and the second CTAT signal 106.

Figure 4:
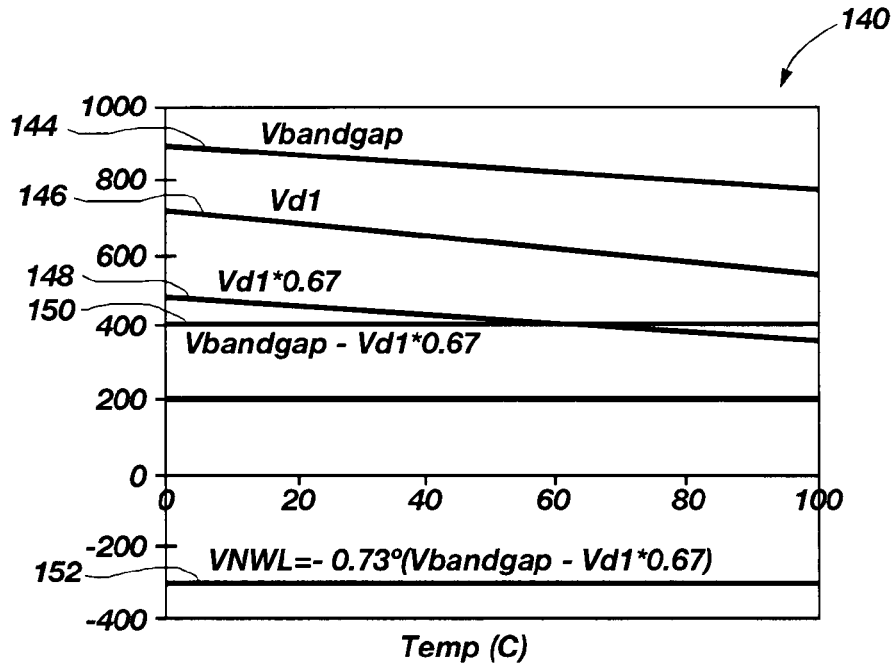
FIG. 4 is a plot diagram of various signals of the circuit of FIG. 3, in accordance with an embodiment of the present invention.

FIG. 4 is a plot diagram of various signals of the circuit of FIG. 3, in accordance with an embodiment of the present invention. A plot diagram 140 illustrates the various signals plotted over an operating range of temperatures and the resultant signal level voltages ranging from 1 volt (1000 mV) to −0.4 volts (−400 mV). A $V_{bandgap}$ plot 144 corresponds to a plot of the first CTAT signal 104 (FIG. 3). The $V_{bandgap}$ plot 144 illustrates a signal that varies with temperature in a complementary relationship characteristic of CTAT signals. Additionally, the first CTAT signal 104 varies with temperature according to a first temperature coefficient (TC).

Similarly, a $V_{d1}$ plot 146 corresponds to a plot of the second CTAT signal 106 (FIG. 3). The $V_{d1}$ plot 146 illustrates a signal that varies with temperature in a complementary relationship characteristic of CTAT signals. Additionally, the second CTAT signal 106 varies with temperature according to a second temperature coefficient (TC). From calculations, one or both of the first and second temperature coefficients may be adjusted to approximate the other temperature coefficient resulting with slopes of both signal plots 144 and 146 approximately equal. In FIG. 4, an exemplary ratio of 0.67 when multiplied with the $V_{d1}$ plot 146 corresponding to the plot of the second CTAT signal 106 (FIG. 3), results in a $V_{d1}$*0.67 plot 148 having a slope (e.g., temperature coefficient (TC)) of an approximately equal magnitude with the $V_{bandgap}$ plot 144. A difference plot 150 is a plot Of $V_{bandgap}$−$V_{d1}$*0.67 resulting in a plot with approximately a zero temperature coefficient (CT) across the illustrated operating range.

Once a zero temperature coefficient (CT) signal for a specific operating temperature range is generated, the signal may be shifted via a differential sensing device 120 (FIG. 3) to a desired level which, in the present embodiments, includes application to applying or "pulling" a word line of a memory cell to a voltage level that is below ground level. In the present example, a reference signal of approximately −300 mV is desirable for a memory device operating with voltage levels of approximately 800 mV to 1000 mV. FIG. 4 illustrates a $V_{nwl_ref}$ plot 152 corresponding to one example of a desired reference level of approximately −300 mV.

Figure 5:
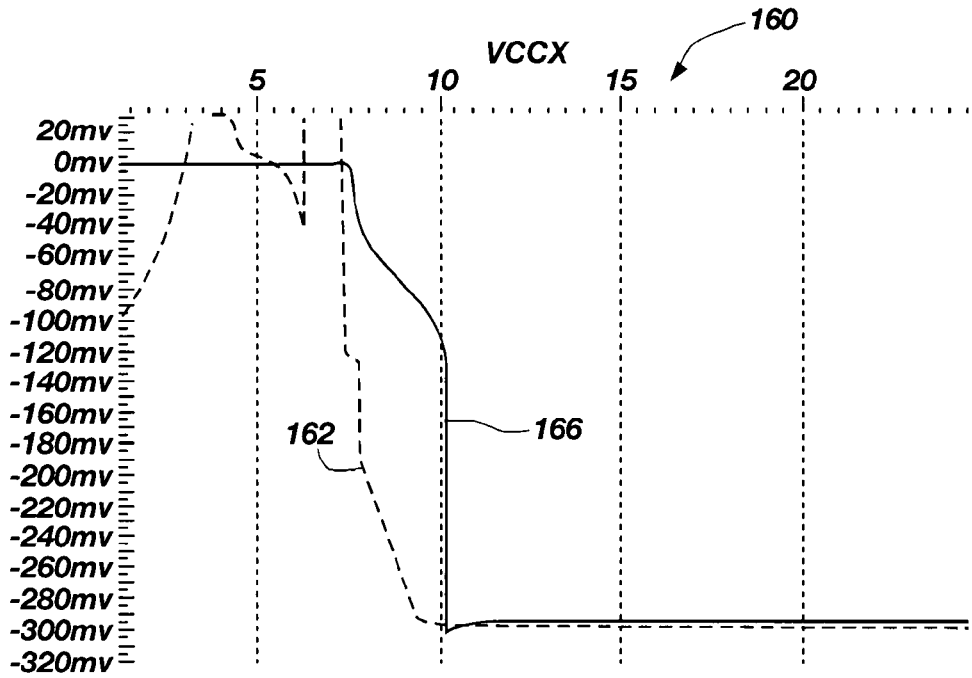
FIG. 5 is a plot diagram illustrating performance of the various voltage reference generators over variations in operating voltage.

FIG. 5 is a plot diagram illustrating performance of the various voltage reference generators over variations in operating voltage, in accordance with an embodiment of the present invention. A plot diagram 160 illustrates the reference signal 126 (FIG. 3) generated from the voltage reference generator 100 (FIG. 3) compared with reference signals generated from prior art reference generators. The plot diagram 160 is plotted at worst case processing (P) parameters (SS) and worst cast temperature (T) parameters (−40° C.). The plot diagram 160 plots the reference signal 126 as a $V_{nwl_ref}$ plot 162 for an operating voltage range for Vccx of approximately 500 mV to 2 volts.

Figure 2:
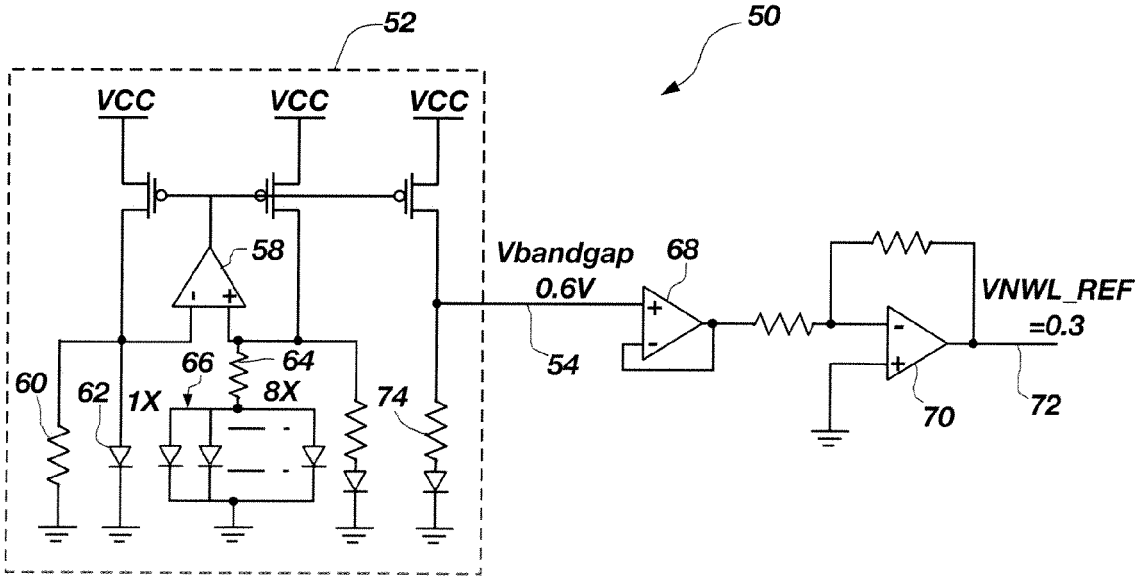
FIG. 2 (PRIOR ART)
FIG. 2 is a circuit diagram of another conventional negative voltage reference generator, in accordance with the prior art.

Similarly, in FIG. 5, the plot diagram 160 illustrates the reference signal 72 (FIG. 2) generated from the voltage reference generator 50 (FIG. 2), in accordance with another implementation in the prior art. The plot diagram 160 plots the reference signal 72 as a $V_{nmw_ref}$ plot 166 across an operating voltage range for Vccx of approximately 500 mV to 2 volts. As illustrated, the voltage reference generator 50 of the prior art maintains an acceptable negative reference signal 72 only above an operating voltage of about 1.05 volts. At a lower operating voltage, the reference signal 72 dramatically returns to a negative potential of approximately 100 mV and then returns to ground or a near zero volt potential over an approximate range of 250 mV. Any benefits from a negative reference signal of approximately −300 mV generated in accordance with the prior art are limited to a relatively high operating voltage of greater than 1.05 volts.

Continuing, the plot diagram 160 illustrates the reference signal 126 (FIG. 3) generated from the voltage reference generator 100 (FIG. 3), in accordance with an embodiment of the present invention. The plot diagram 160 plots the reference signal 126 as a $V_{nwl_ref}$ plot 162 across an operating voltage range for Vccx of approximately 500 mV to 2 volts. As illustrated, the voltage reference generator 100 of an embodiment of the present invention maintains a desired negative reference signal 126 above an operating voltage of about 0.85 volts. At a lower operating voltage down to approximately 0.75 volts, the reference signal 126 maintains an acceptable negative potential of approximately −200 mV to −100 mV and then returns to ground or near zero volt potential at an operating range of less than approximately 0.75 volts. From the illustrations in the plot diagram 160, the improvements to the range of the reference signal 126 in $V_{nwl_ref}$ plot 162 illustrates the expanded range of the reference signal 126 as generated by the voltage reference generator 100 over operating voltage ranges for Vccx of approximately 0.75 V to greater than 2 volts.

Figure 6:
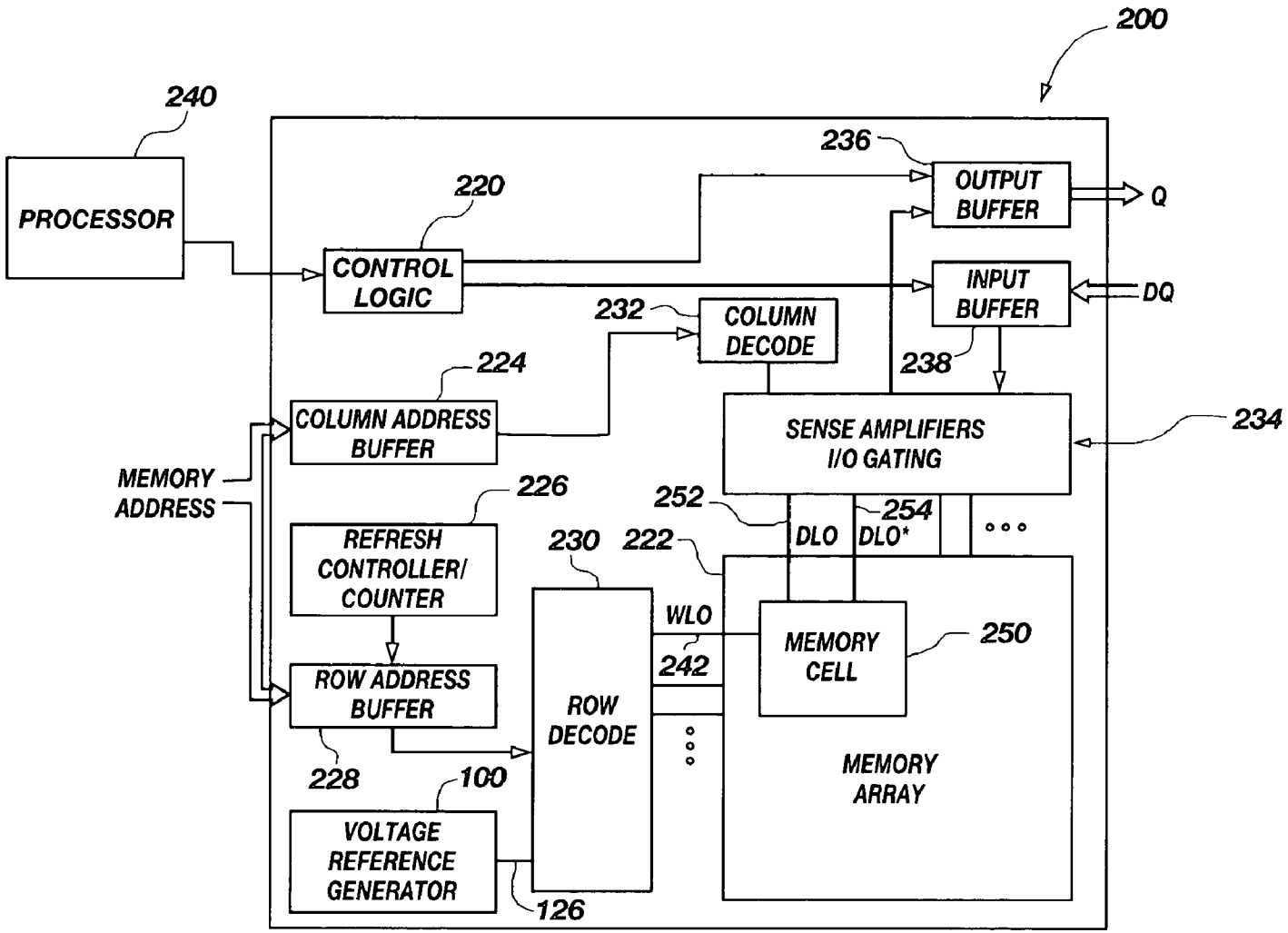
FIG. 6 is a block diagram of a memory device including a voltage reference generator, in accordance with another embodiment of the present invention.

FIG. 6 is a block diagram of a memory device including a voltage reference generator, in accordance with another embodiment of the present invention. A DRAM memory device 200 includes control logic circuit 220 to control read, write, erase and perform other memory operations. A column address buffer 224 and a row address buffer 228 are adapted to receive memory address requests. A refresh controller/counter 226 is coupled to the row address buffer 228 to control the refresh of the memory array 222. A row decode circuit 230 is coupled between the row address buffer 228 and the memory array 222. A column decode circuit 232 is coupled to the column address buffer 224. Sense amplifiers-I/O gating circuit 234 is coupled between the column decode circuit 232 and the memory array 222. The DRAM memory device 200 is also illustrated as having an output buffer 236 and an input buffer 238. An external processor 240 is coupled to the control logic 220 of the DRAM memory device 200 to provide external commands.

A voltage reference generator 100 generates a reference signal 126 for coupling with the word lines 242 when inactive, in accordance with the one or more embodiments of the present invention. A memory cell M1 250 of the memory array 222 is shown in FIG. 6 to illustrate how associated memory cells are implemented in the present invention. The word lines 242 are coupled to the pass or access gates of the memory cell M1 250. When the word lines 242 are inactive, the leakage of the charge stored in memory cell 250 is reduced by coupling the inactive word lines WL 242 to the reference signal 126 maintained at a potential below ground. When the memory cell 250 is read, the retained charge is discharged to digit lines DL0 252 and DL0* 254. Digit line DL0 252 and digit line DL0* 254 are coupled to a sense amplifier in circuit 234.

Figure 7:
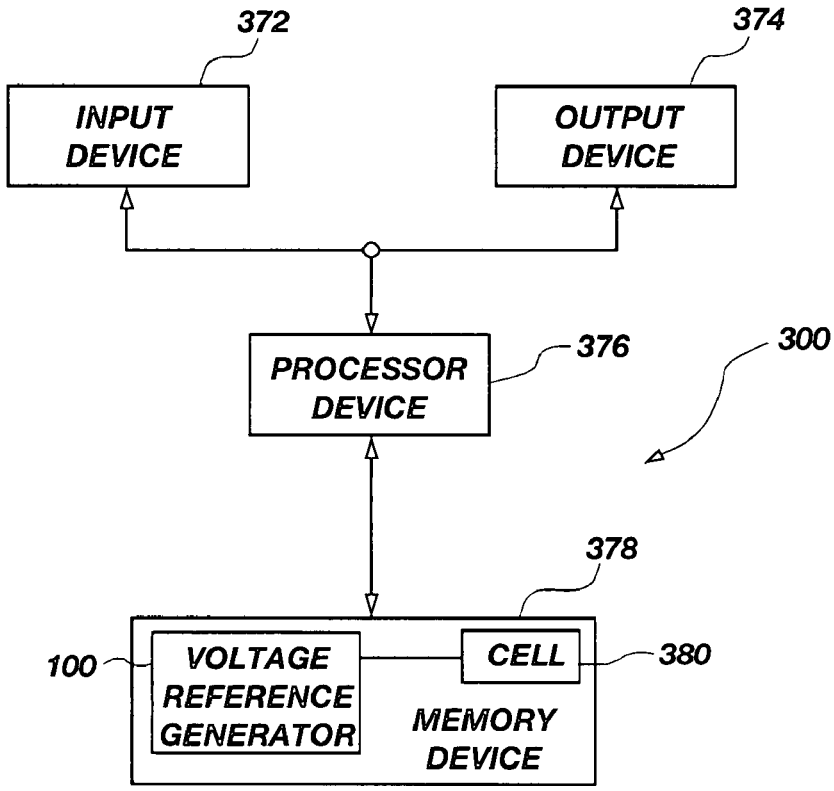
FIG. 7 is a block diagram of an electronic system including a memory device further including a voltage reference generator, in accordance with a further embodiment of the present invention.

FIG. 7 is a block diagram of an electronic system including a memory device, in accordance with a further embodiment of the present invention. The electronic system 300 includes an input device 372, an output device 374, and a memory device 378, all coupled to a processor device 376. The memory device 378 incorporates at least one voltage reference generator 100 of one or more of the preceding embodiments of the present invention for coupling with an inactive word line of at least one memory cell 380.

Figure 8:
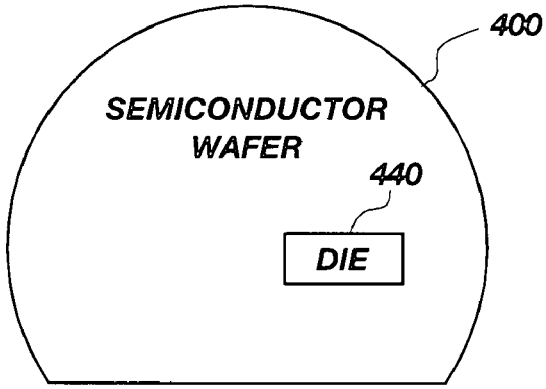
FIG. 8 is a diagram of a semiconductor wafer including a memory device, in accordance with yet another embodiment of the present invention.

FIG. 8 is a diagram of a semiconductor wafer including a memory device further including a voltage reference generator, in accordance with yet another embodiment of the present invention. As shown in FIG. 8, a semiconductor wafer 400 includes a yet-to-be segmented integrated circuit die 440 that incorporates one or more memory devices including a voltage reference generator as herein disclosed.

Figure 9:
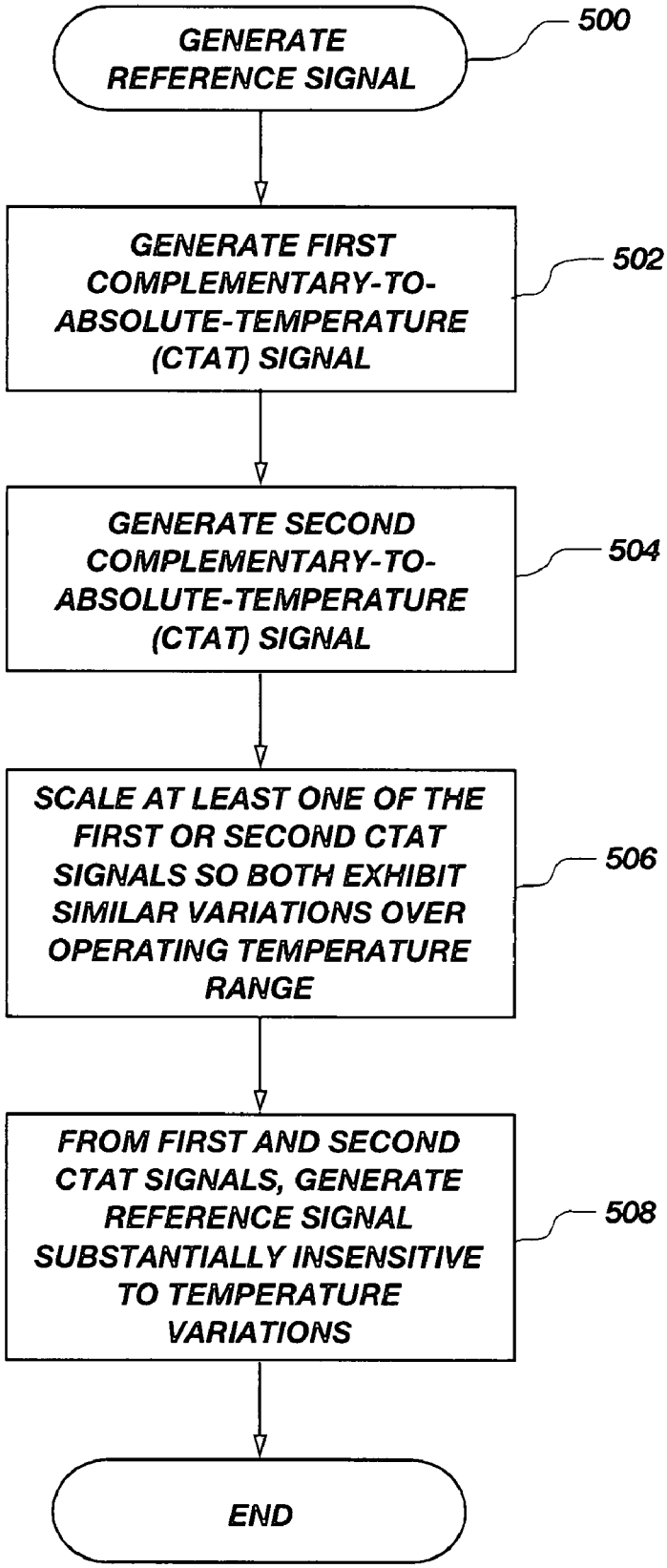
FIG. 9 is a flowchart of a method for generating a reference signal, in accordance with yet a further embodiment of the present invention.

FIG. 9 is a flowchart for generating a reference signal from first and second complementary-to-absolute-temperature (CTAT) signals, in accordance with an embodiment of the present invention. A method 500 for generating a reference signal includes generating 502 a first complementary-to-absolute-temperature (CTAT) signal. The first CTAT signal may be generated from a bandgap voltage reference circuit 102 such as previously described with reference to FIG. 3. The first CTAT signal may be generated as a voltage signal that is generated as an output of a bandgap voltage reference circuit but exhibits an inversely varying relationship to temperature.

The method for generating a reference signal further includes generating 504 a second complementary-to-absolute-temperature (CTAT) signal. The second CTAT signal may also be generated from a bandgap voltage reference circuit 102 such as previously described with reference to FIG. 3. The second CTAT signal may be generated as a voltage signal that is generated as an output of a diode within a bandgap voltage reference circuit but exhibits an inversely varying relationship to temperature and is nonorthogonal with the first CTAT signal. The second CTAT signal may be further buffered such as through a unity gain buffer, for example, to provide a compatible output impedance for further coupling with other circuitry.

The method for generating a reference signal yet further includes scaling 506 at least one of the first and second CTAT signals such that both first and second CTAT signals exhibit a substantially equivalent variation to temperature over a desired operating temperature range. The method further includes generating 508 a reference signal substantially insensitive to temperature variations over an operating temperature range from differentially sensing the first and second CTAT signals.

The various embodiments of the present invention as described herein provide for an improved generation of a reference signal at a lower voltage than reference signals produced by conventional voltage reference generators. The voltage reference generator of the various embodiments of the present invention provide a circuit configured to utilize two CTAT signals from a low voltage bandgap voltage reference to generate a reference signal that is less sensitive to processing (P), voltage (V) and temperature (T) variations and is capable of maintaining a reference signal at a beneficial potential over a decreased operating voltage range.

Although the present invention has been described with reference to particular embodiments, the invention is not limited to these described embodiments. Rather, the invention is limited only by the appended claims, which include within their scope all equivalent devices or methods that operate according to the principles of the invention as described.

What is claimed is:

1. A voltage reference generator, comprising:

a bandgap voltage reference circuit configured to generate a first complementary-to-absolute-temperature (CTAT) signal varying with a first temperature coefficient and a second complementary-to-absolute-temperature (CTAT) signal varying with a different second temperature coefficient; and a differential sensing device configured to scale the first and second CTAT signals to exhibit approximately equal temperature coefficients and to generate a reference signal therefrom, wherein the reference signal is at a level below ground potential over an operating temperature range.

2. The voltage reference generator of claim 1, wherein at least one of the first and second CTAT signals are configured to be sensitive to temperature variations over an operating temperature range.

3. The voltage reference generator of claim 1, wherein the differential sensing device is configured to scale at least one of the first and second CTAT signals causing the reference signal to exhibit substantially a temperature coefficient of zero over an operating temperature range.

4. The voltage reference generator of claim 1, further comprising a buffer configured to condition at least one of the first and second CTAT signals for coupling with the differential sensing device.

5. The voltage reference generator of claim 1, wherein at least one of the first and second CTAT signals includes a nonzero temperature coefficient.

6. A method for generating a reference signal, comprising:

generating a first complementary-to-absolute-temperature (CTAT) signal varying with a first temperature coefficient;

generating a second complementary-to-absolute-temperature (CTAT) signal varying with a different second temperature coefficient;

scaling at least one of the first and second CTAT signals to exhibit substantially equivalent temperature coefficients; and generating the reference signal by differentially sensing the first and second CTAT signals having the substantially equivalent temperature coefficients, wherein generating the refernce signal includes generating the reference signal at a level below ground potential over an operating temperature range.

7. The method of claim 6, wherein the at least one of the first and second CTAT signals are configured to be sensitive to temperature variations over an operating temperature range.

8. The method of claim 6, wherein scaling further comprises scaling the at least one of the first and second CTAT signals to exhibit substantially equivalent temperature coefficients over an operating temperature range.

9. The method of claim 6, further comprising buffering the at least one of the first and second CTAT signals before differentially sensing the first and second CTAT signals.

10. The method of claim 6, wherein the at least one of the first and second CTAT signals includes a nonzero temperature coefficient.

11. A memory device, comprising:

a memory array; and a voltage reference generator configured to facilitate data retention with the memory array, including:

a bandgap voltage reference circuit configured to generate a first complementary-to-absolute-temperature (CTAT) signal varying with a first temperature coefficient and a second complementary-to-absolute-temperature (CTAT) signal varying with a different second temperature coefficient; and a differential sensing device configured to scale the first and second CTAT signals to exhibit approximately equal temperature coefficients and to generate a reference signal therefrom, wherein generating the reference signal includes generating the reference signal at a level below ground potential over an operating temperature range.

12. The memory device of claim 11, wherein at least one of the first and second CTAT signals are configured to be sensitive to temperature variations over an operating temperature range.

13. The memory device of claim 11, wherein the differential sensing device is configured to scale at least one of the first and second CTAT signals causing the reference signal to exhibit substantially a temperature coefficient of zero over an operating temperature range.

14. The memory device of claim 11, further comprising a buffer configured to condition at least one of the first and second CTAT signals for coupling with the differential sensing device.

15. The memory device of claim 11, wherein at least one of the first and second CTAT signals includes a nonzero temperature coefficient.

* * * * *

UNITED STATES PATENT AND TRADEMARK OFFICE

CERTIFICATE OF CORRECTION

PATENT NO. : 7,489,184 B2
APPLICATION NO. : 11/711563
DATED : February 10, 2009
INVENTOR(S) : Pan et al.

It is certified that error appears in the above-identified patent and that said Letters Patent is hereby corrected as shown below:

In column 10, line 17, in Claim 6, delete “refernce” and insert -- reference --, therefor.

In column 10, lines 46-47, in Claim 11, after “wherein” delete “generating the reference signal includes generating”.

In column 10, line 47, in Claim 11, after “signal” insert -- is --.

Signed and Sealed this

Twenty-first Day of April, 2009

John Doll

JOHN DOLL
*Acting Director of the United States Patent and Trademark Office*